US010293513B2

(12) United States Patent
Wang

(10) Patent No.: US 10,293,513 B2
(45) Date of Patent: May 21, 2019

(54) DADO INDEXING JIG AND METHOD OF CUTTING A DADO

(71) Applicant: MICRO JIG, INC., Winter Springs, FL (US)

(72) Inventor: Henry Wang, Winter Springs, FL (US)

( * ) Notice: Subject to any disclaimer, the term of this patent is extended or adjusted under 35 U.S.C. 154(b) by 572 days.

(21) Appl. No.: 15/044,308

(22) Filed: Feb. 16, 2016

(65) Prior Publication Data

US 2017/0232636 A1 Aug. 17, 2017

(51) Int. Cl.
*B27F 5/02* (2006.01)

(52) U.S. Cl.
CPC ..... *B27F 5/026* (2013.01)

(58) Field of Classification Search
CPC ..... B27F 5/00; B27F 5/02; B27F 1/12; B27G 23/00; B25B 1/00; B25B 1/02; B25B 1/10; B25B 5/00; B27C 5/02; B27C 5/04; B27C 5/06
USPC ..... 144/144.1, 144.51, 144.52, 145.1; 269/43, 63, 70, 60, 90, 98
See application file for complete search history.

(56) References Cited

U.S. PATENT DOCUMENTS

| | | | | |
|---|---|---|---|---|
| 2,526,626 | A | 10/1950 | Basso | |
| 7,748,420 | B2 * | 7/2010 | Young | B23Q 3/069 144/144.52 |
| 8,459,318 | B2 | 6/2013 | Vice | |
| 8,746,116 | B2 | 6/2014 | Economaki | |
| 2009/0315238 | A1 * | 12/2009 | Schroeder | B25B 1/02 269/142 |
| 2014/0331839 | A1 | 11/2014 | Noguchi | |
| 2015/0343607 | A1 | 12/2015 | Wang | |

* cited by examiner

*Primary Examiner* — Matthew Katcoff
(74) *Attorney, Agent, or Firm* — Robert L. Wolter, Esq.; Beusse Wolter Sanks & Maire, PLLC

(57) ABSTRACT

A dado indexing jig includes a plurality of indexing members and indexing surfaces that are adjustable relative to one another and a cutting element to account for a width of a workpiece that corresponds to the width of a dado to be cut. In addition, the indexing surfaces are adjustable to account for a width of a blade or router to cut a dado.

11 Claims, 19 Drawing Sheets

DADO INDEXING JIG AND METHOD OF CUTTING A DADO

BACKGROUND OF THE INVENTION

The present invention relates generally to tools used to make one or more dados in a workpiece. More specifically, the present invention relates to woodworking tools used to align a workpiece relative to a cutting element to cut one or more dados.

Shelving for cabinets, book shelves, drawers and the like often include brackets to secure horizontal members or cross members to vertical members. However, a common method of fabricating this type of furniture is by cutting dados in the vertical member, whereby the dados have a width dimension corresponding to a thickness dimension of the cross members. Opposite ends or edges of the cross members are inserted into the dados. Glue and/or fasteners may be provided to strengthen the interface between the cross members and vertical members.

Dados are typically cut on a table saw with a dado saw blade set or dados may be cut using a router with a pre-determined cutting diameter router bit secured at a desired bit height. A dado saw blade set consists of multiple saw blades that may have the same or differing thickness stacked together so the blade sets have a thickness corresponding to a thickness of the shelves. A stack of dado shims are inserted between consecutively aligned saw blades to more precisely match the width of the dado saw blade set to the thickness of the cross members. A disadvantage of using a dada saw blade set is that this thickness matching step may require several trial and error test cuts.

Moreover, the blades of a dado saw blade set usually have a smaller diameter relative those saw blades that are typically used for making cuts, or removing material, thereby requiring a different saw blade insert. In addition, certain table saws may require different safety equipment to be installed in order to use dado saw blades having the smaller diameter.

The stacked dado saw blade set usually removes two to eight times more material than a typical saw blade, requiring a more powerful motor to drive the dado saw blade set and a well-maintained table saw to effectively and safely cut a dado with stacked dado saw blades. This often adds a significant amount of expense and a significant time consuming setup. To that end, it is recommended, for safety reasons, to not use a dado blade set on an under-powered table saw.

Each saw blade on the market has a blade body thickness and an offset dimension between the blade body and the width of carbide tips that are unique to a respective blade make and model. However, these dimensions may vary even for the same model made by the same manufacturer. The differing dimension between two blades can be as small as a few thousands of an inch to about sixty thousands of an inch. In addition, every saw blade gets dull after a period of time and needs to be sharpened. Every sharpening changes the offset dimension, because the carbide tips will be grounded narrowing the carbide tip, which alters the offset dimension. Each of these variable dimensions makes the setup of a dado saw blade difficult to precisely match the width of a dado cut or cross member without trial and error test cuts.

Many table saw operators use plywood router bits instead of a dado saw blade set; however, plywood router bits create a different problem. There are router bits made specifically for plywood shelving and are manufactured to specific diameters. However, the set thickness on sheets of plywood in today's market may vary from sheet to sheet and these varying thickness do not match the set diameters of the plywood router bits. Because of the fixed cutting diameter of the plywood router bits, almost every cut is either oversized or undersized. This creates an undesirable fit and affects the strength of the shelving unit.

BRIEF DESCRIPTION OF THE DRAWINGS

These and other advantages of the invention will become more apparent from the following description in view of the drawings. Similar structures illustrated in more than one figure are numbered consistently among the drawings.

FIG. 13A is a detailed top view of the cutting element in FIG. 13.

DESCRIPTION OF THE INVENTION

Figure 1:
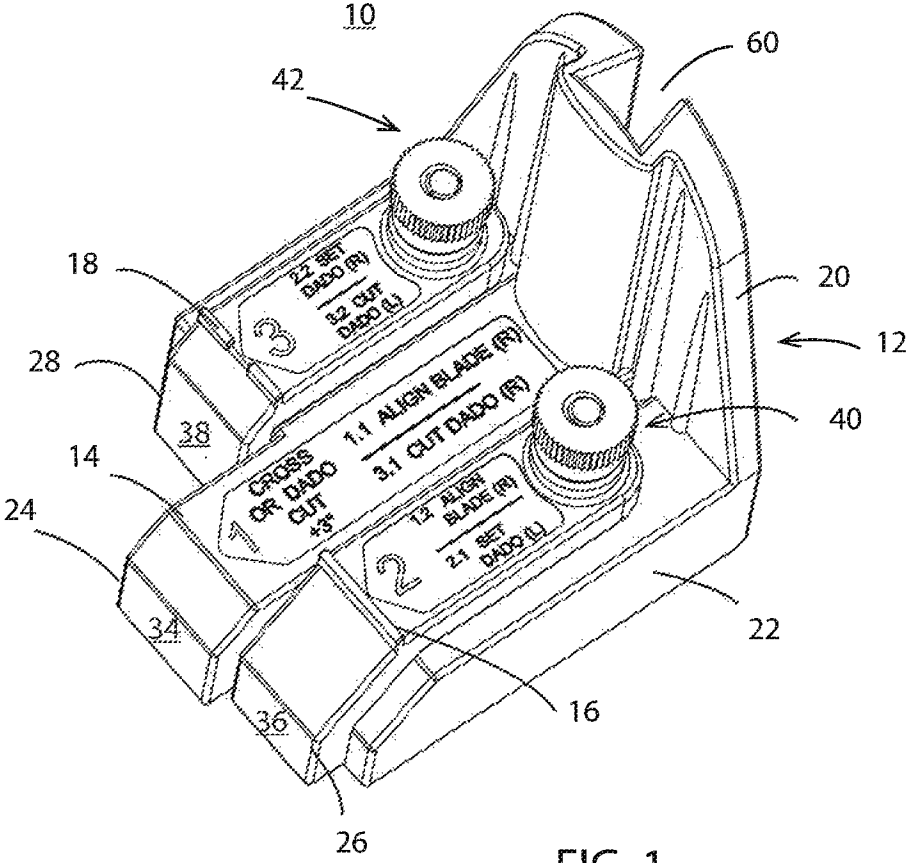
FIG. 1 is a perspective view of a dado indexing jig in accordance with aspects of the invention.

The inventor of the present invention has developed a jig used to cut a dado and a method of cutting a dado that provide an easy, effective and inexpensive setup to repeatedly and precisely cut a dado on a first work piece every time, regardless of the differing thickness of a second workpiece to workpiece to be inserted into a dado. This can be accomplished with a table saw blade or router that is used on a daily basis for various other cutting operations. Expensive equipment is not required to adapt the table saw or router for cutting a dado, and time consuming trial and error test cuts are eliminated. The device may be used on table saws and router tables of any power level.

In addition, one is not required to know the width or offset of the saw blade being used, for instant, a cutting element with imperial dimension can produce a wider dado that is measured in metrics without any calculations or conversions involved. The present invention provides reference or index contact surfaces that are positioned relative to one another at the precise width of the dado. The positioning of these indexing surfaces provides the precise location of opposing edges of both sides of the dado. In addition, the same cutting element removes the material a first and second cut after these cuts are made. This invention can also be used in the same manner on a typical table saw or with a reversely mounted router, both of which are preferably equipped with a guide fence.

A common dado width is between ¼ to ¾. The exact width of a dado to be cut is identical to the distance indexed between an end surface 36 of indexing member 16 and end surface 38 of third indexing member 18 by contacting references of the thickness of workpiece 78 to be inserted into the dado, while the indexed distance between end surface 34 of the first indexing member 14 and end surface 36 of second indexing member 16 is identical to the thickness of cutting element 66.

For the purposes of promoting an understanding of the principles and operation of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to those skilled in the art to which the invention pertains.

It is important to an understanding of the present invention to note that all technical and scientific terms used herein, unless defined herein, are intended to have the same meaning as commonly understood by one of ordinary skill in the art. The techniques employed herein are also those that are known to one of ordinary skill in the art, unless stated otherwise. For purposes of more clearly facilitating an understanding of the invention as disclosed and claimed herein, the preceding definitions are provided. It is further noted that the terms "first," "second," and the like as used herein do not denote any order, quantity, or importance, but rather are used to distinguish one element from another. The terms "a" and "an" do not denote a limitation of quantity, but rather denote the presence of at least one of the referenced item.

The term "indexing member" as used to describe aspects of the invention herein means a component of the jig that is used to position a workpiece relative to a cutting element to cut a dado. The term "workpiece" as used to describe aspects of the invention herein means a member that is to be cut for forming a dado or a member that may be used in conjunction with the jig to position another workpiece relative to a cutting element to cut a dado.

Figure 2:
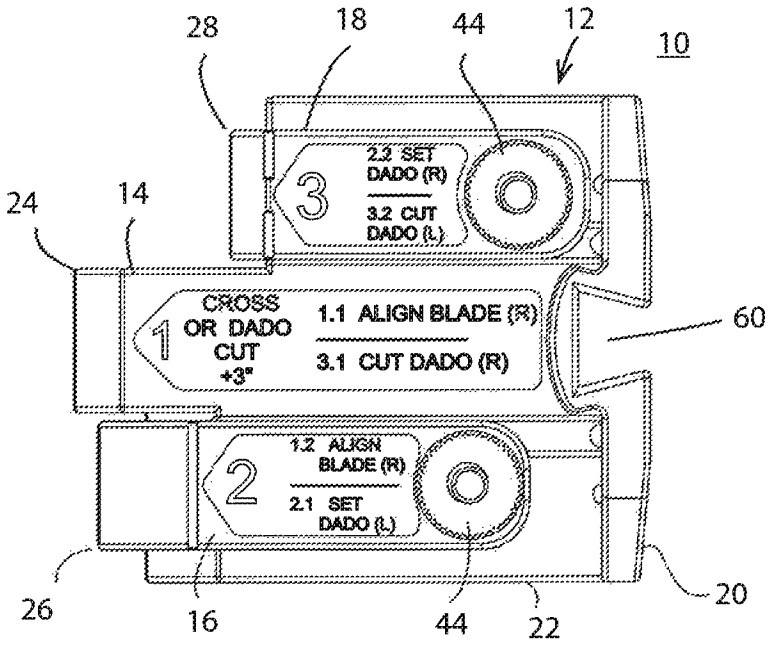
FIG. 2 is a top view of the dado indexing jig.
Figure 8:
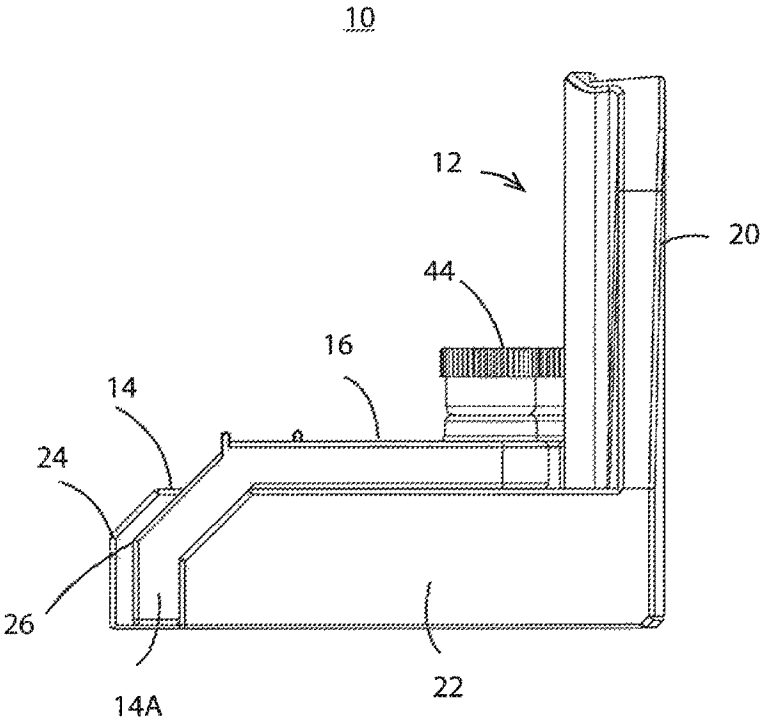
FIG. 8 is a second side elevational view of the dado indexing jig.
Figure 7:
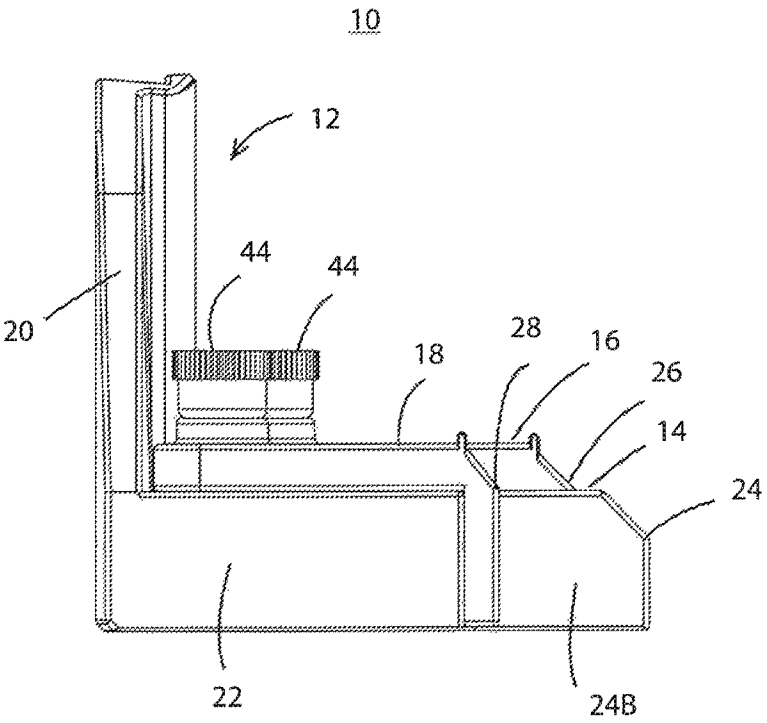
FIG. 7 is a first side elevational view of the dado indexing jig.

With respect to FIGS. 1 and 2, an embodiment of the present invention for a dado indexing jig 10 is illustrated. As shown, the jig 10 includes a base 12, and three indexing members 14, 16, 18 operatively connected to the base 10. The indexing members include a first indexing member 14, a second indexing member 16 and a third indexing member 18. Each indexing member 14, 16, 18 includes a respective end 24, 26, 28 with a respective end surface 34, 36, 38. As shown in FIGS. 7 and 8, the first indexing member 14 includes a first side 14A and a second side 14B. The second indexing member 16 is adjacent to the first side 14A and the third indexing member 18 is adjacent to the second side 14B.

Figure 4:
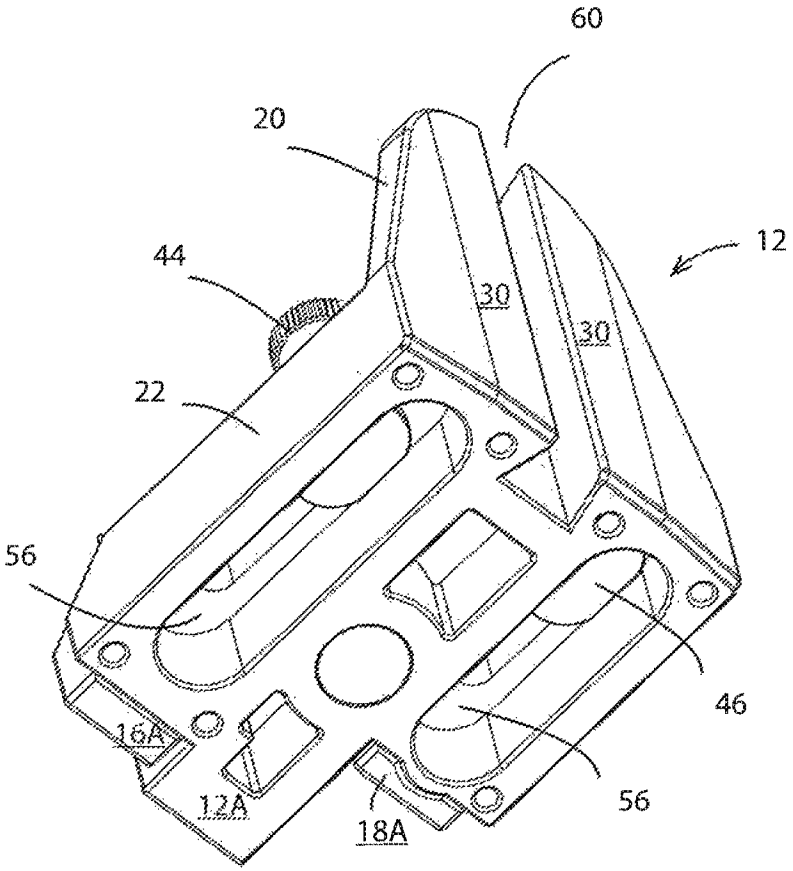
FIG. 4 is a bottom perspective view of the dado indexing jig.
Figure 6:
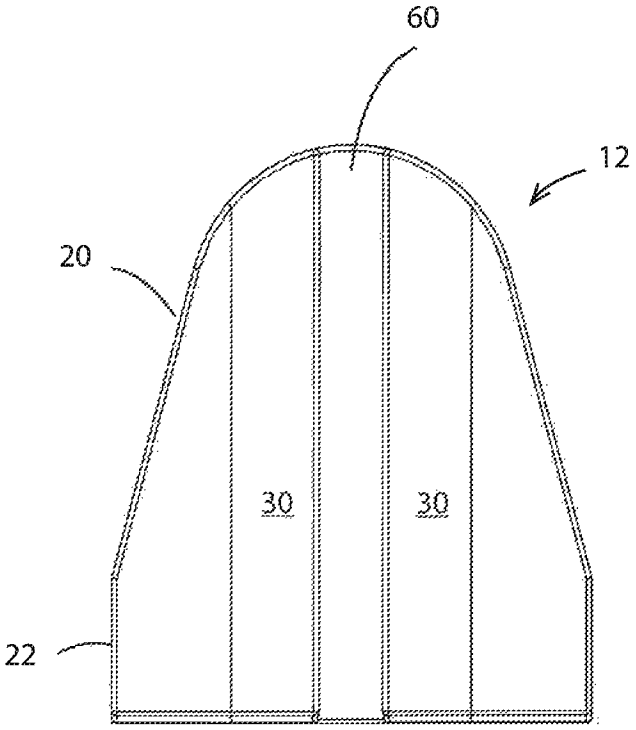
FIG. 6 is a rear elevational view of the dado indexing jig.
Figure 5:
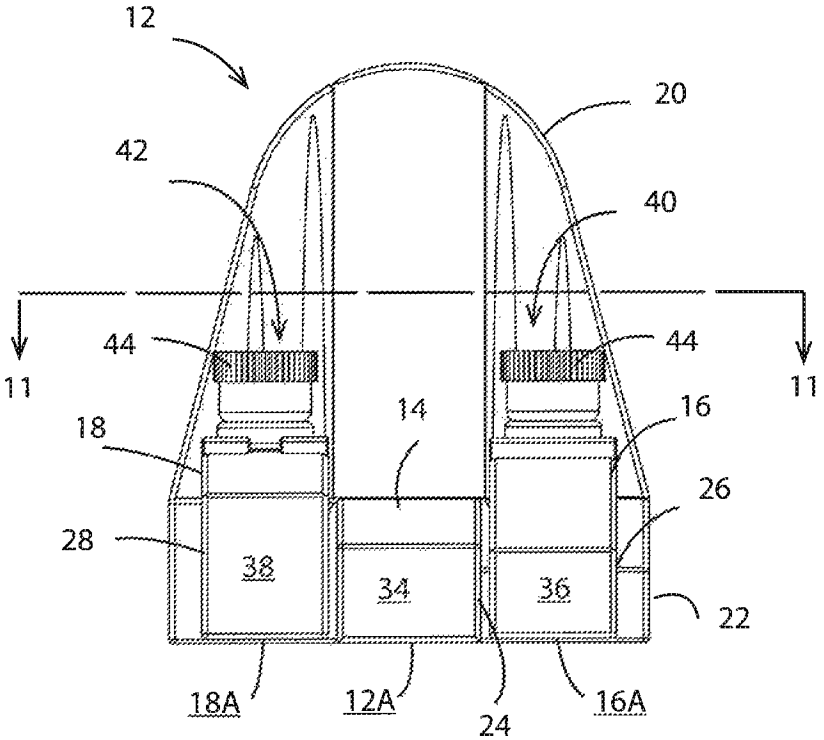
FIG. 5 is a front elevational view of the dado indexing jig.

The base 12 may comprise a vertical section 20 and a horizontal section 22. As shown in FIGS. 4 and 6, the base 12 has a generally flat back surface 30 that extends the length of the vertical section 20. The end surfaces 34, 36, 38 are parallel to the back surface 30. As will be explained in more detail below, the jig 10 may be secured to a fence of a work table that includes a cutting element, whereby the jig 10 is disposed between the fence and the cutting element. The positions of ends 24, 26, 28 of indexing members 14, 16, 18 are adjustable on the work table to align a workpiece relative to the cutting element to cut a dada using the cutting element. Indexing members 16, 18 have respective bottom surfaces 16A, 18A that are vertically offset relative to a bottom surface 12A of the base 12, so the indexing members 16, 18 don't drag along a work surface when adjusting their respective positions.

In the embodiment described herein the first indexing member 14 is affixed to the base 12 and is not moveable relative to the base 12 when adjusting a position of the end 24. However, the position of the end 24 of the first indexing member 14 is adjustable on the work table by virtue of movement of the base 12 and/or the fence. However, the invention is not so limited and embodiments may comprise the first indexing member 14 being moveable relative to the base 12.

Figure 12:
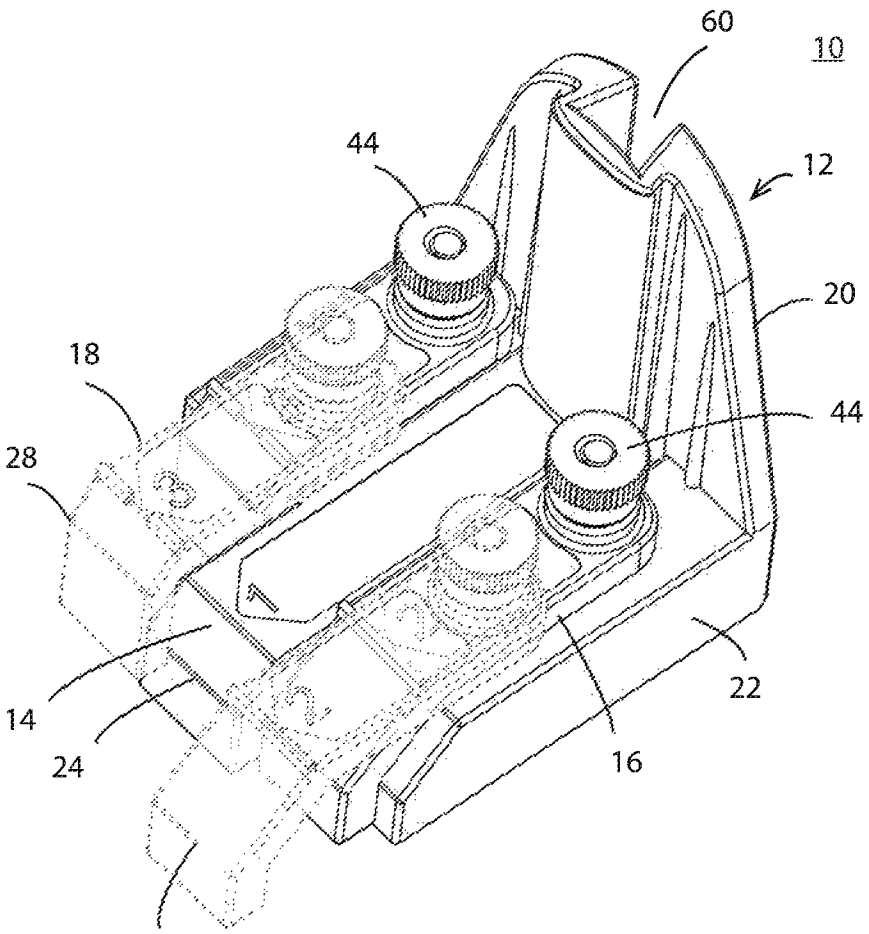
FIG. 12 is a top perspective view of the dado indexing jig illustrating adjustment of indexing members.

The second and third indexing members 16, 18 are preferably provided in sliding engagement with the horizontal section 22 of the base 10. Stop mechanisms 40, 42 are provided to secure the indexing members 16, 18 to the base 10, and the stop mechanisms may be actuated to allow the respective positions of the indexing members 40, 42 to be adjusted. As shown in FIG. 12, the jig 10 includes a first releasable stop mechanism 40 operatively connected to the second indexing mechanism 16 and the horizontal section 22 of the base 12. In addition, a second stop mechanism 42 is operatively connected to the second indexing mechanism 16 and the horizontal section 22 of the base 12.

Figure 9:
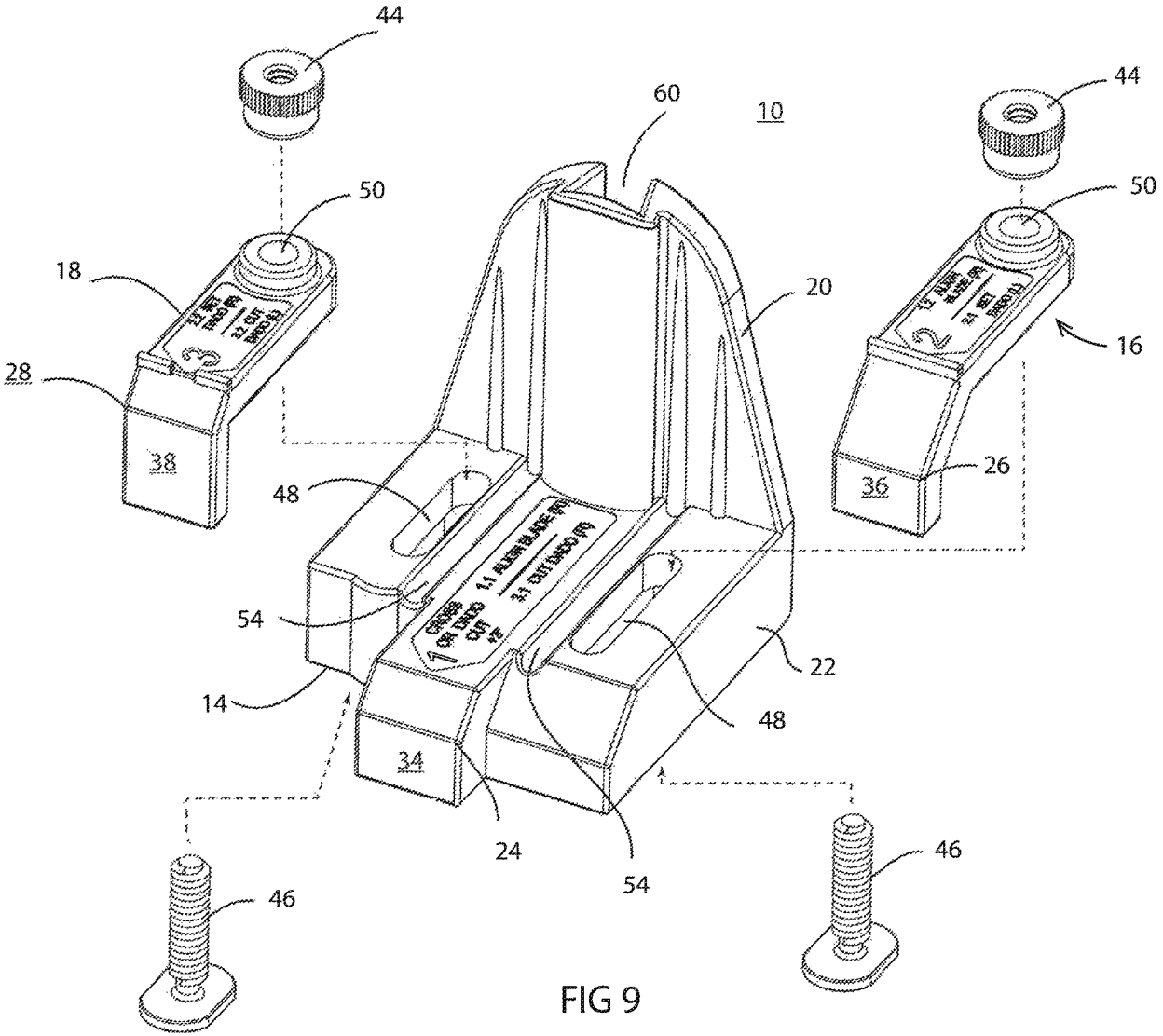
FIG. 9 is a top perspective exploded view of the dado indexing jig.
Figure 10:
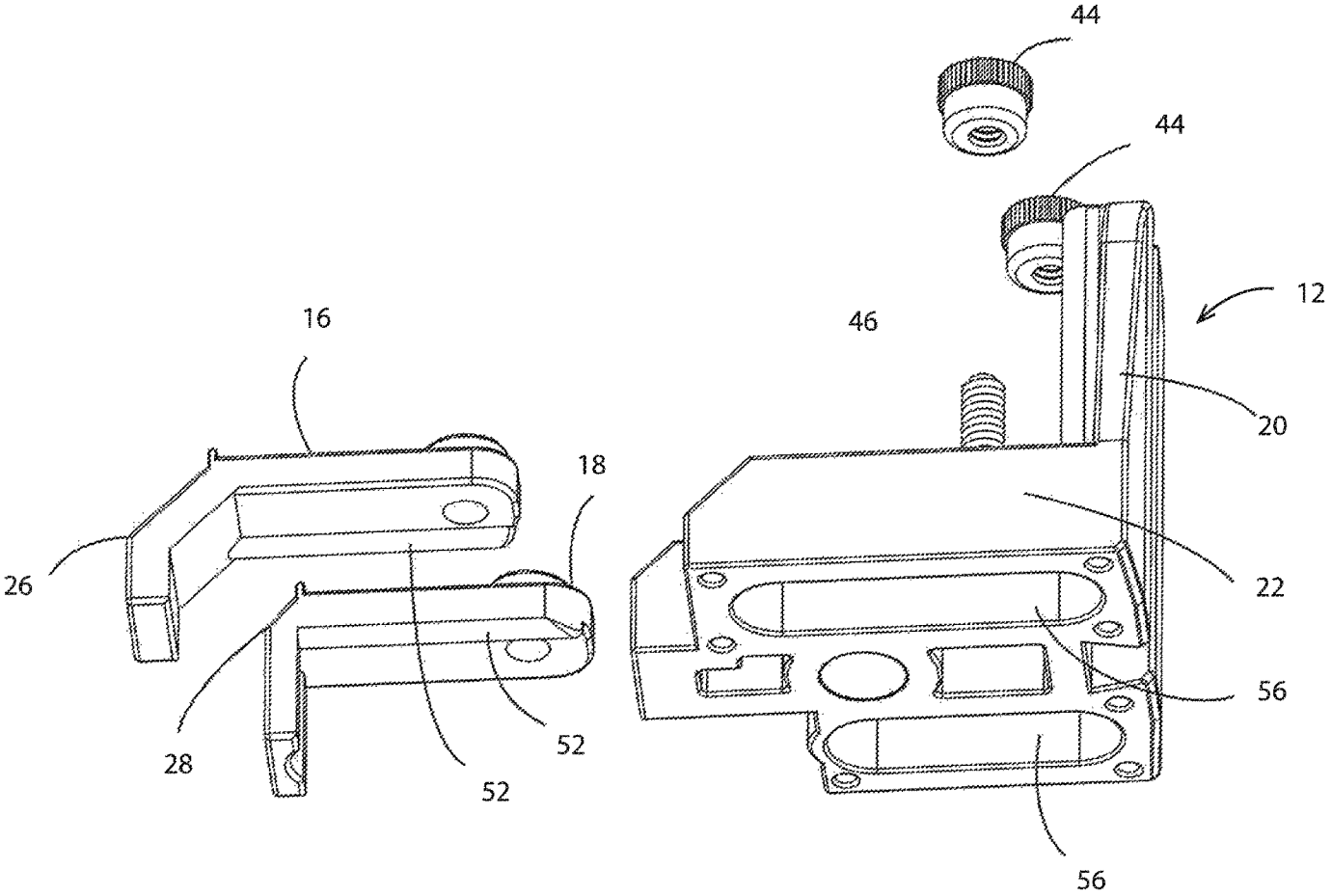
FIG. 10 is a bottom perspective exploded view of the dado indexing jig.
Figure 11:
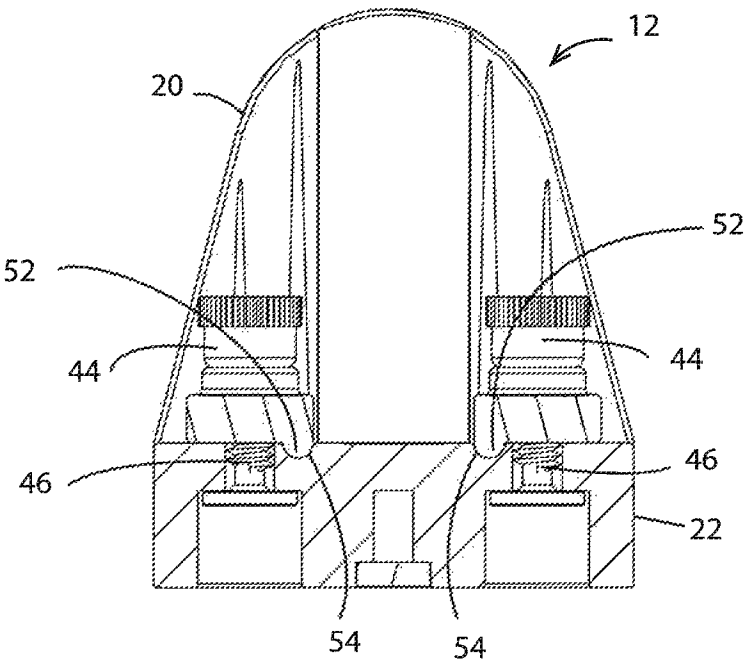
FIG. 11 is a sectional view taken along lines 11-11 in FIG. 5.

With respect to FIGS. 9, 10 and 11, the stop mechanisms 40, 42 may include a threaded knob 44 and bolt assembly 46. As shown, the bolts 46 are inserted through slots 48 formed in the horizontal section 22 of the base 12, and holes 50 in the indexing members 16, 18. The knobs 44 are in threaded engagement with the bolts 46 for loosening and tightening so the indexing members 16, 18 may slide or move on the base to a desired position for positioning a workpiece relative to a cutting element to cut a dado. In a preferred embodiment, the indexing members include protrusions 52 that are in mating relationship with recesses 54 on the horizontal section 22 of the base 12. Such a configuration prevents lateral disposition of the ends 26, 28 of the indexing members 16, 18 when tightening the knobs 44 against the base 12. In addition, the heads of the bolts 46 are disposed within cavities 56 (also shown in FIG. 4) of the base 12 so as not to interfere with the positioning of the jig 10 on a work table.

The invention is not limited to any particular mechanism or method of adjusting the indexing members 14, 16, 18, and the invention is not limited to the above-described screw, knob and sliding assembly. The invention covers any mechanism or method for adjusting positions of the ends 24, 26, 28 as necessary for aligning a workpiece relative to a cutting element to cut a dado.

Figure 3:
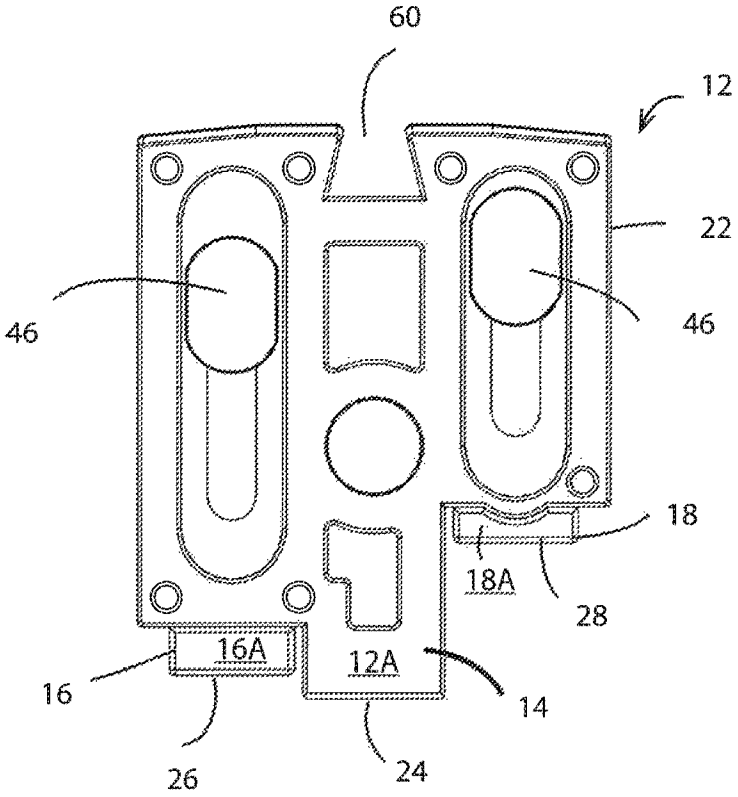
FIG. 3 is a bottom view of the dado indexing jig.

In reference to FIGS. 3, 4 and 6, the base 12 includes a back surface 58 along the vertical section 20 and horizontal section 22 of the base 12. The end surfaces 34, 36, 38 are parallel to the indexing members 14, 16, 18. Accordingly, when the jig 10 is positioned on a work table, the back surface 58 abuts a surface of a fence on the work table, so the end surfaces 34, 36, 38 are parallel to the surface of the fence.

The jig 10 also includes a channel 60 that is configured to receive a clamp or clamping member. In a preferred embodiment, the channel 60 has a tapered cross-sectional shape to receive a similarly shaped arm of clamp as described in U.S. Publication No. 2015/0343607, which is incorporated herein by reference.

Figure 13:
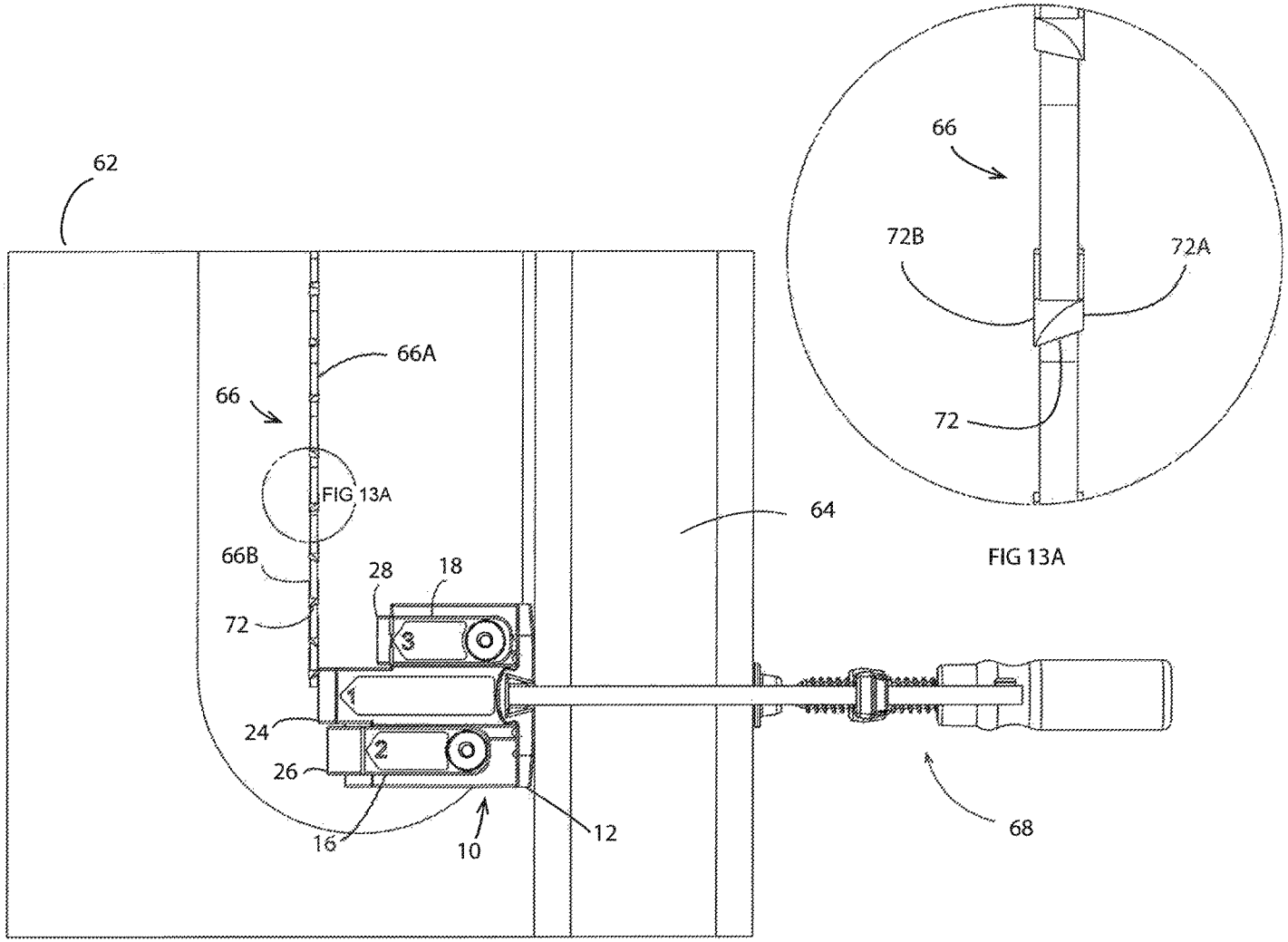
FIG. 13 is a top view of a table saw showing a first step of a method of cutting a dado.
Figure 20:
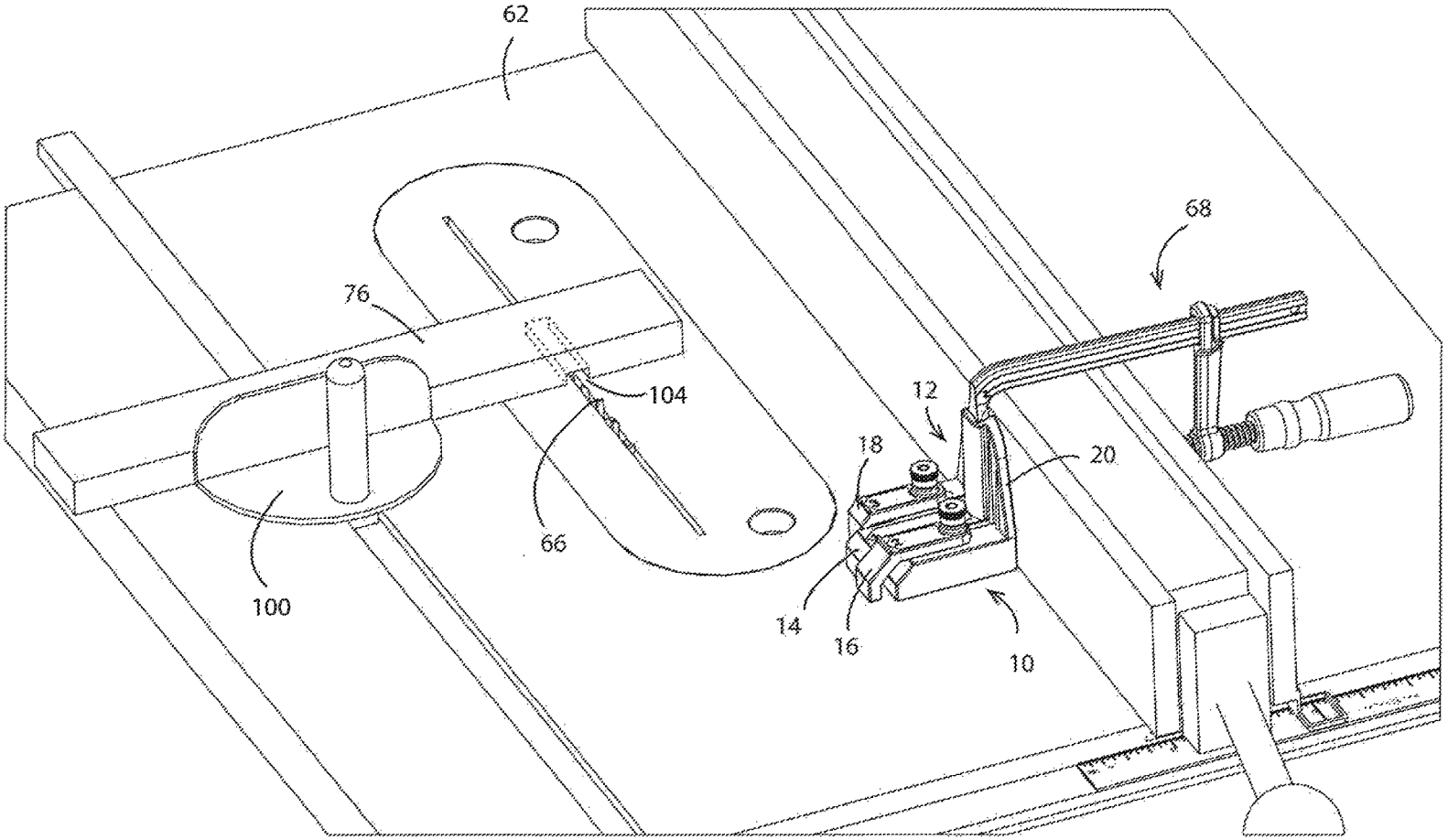
FIG. 20 is a perspective view of a table showing an eighth step of a method of cutting a dado.
Figure 21:
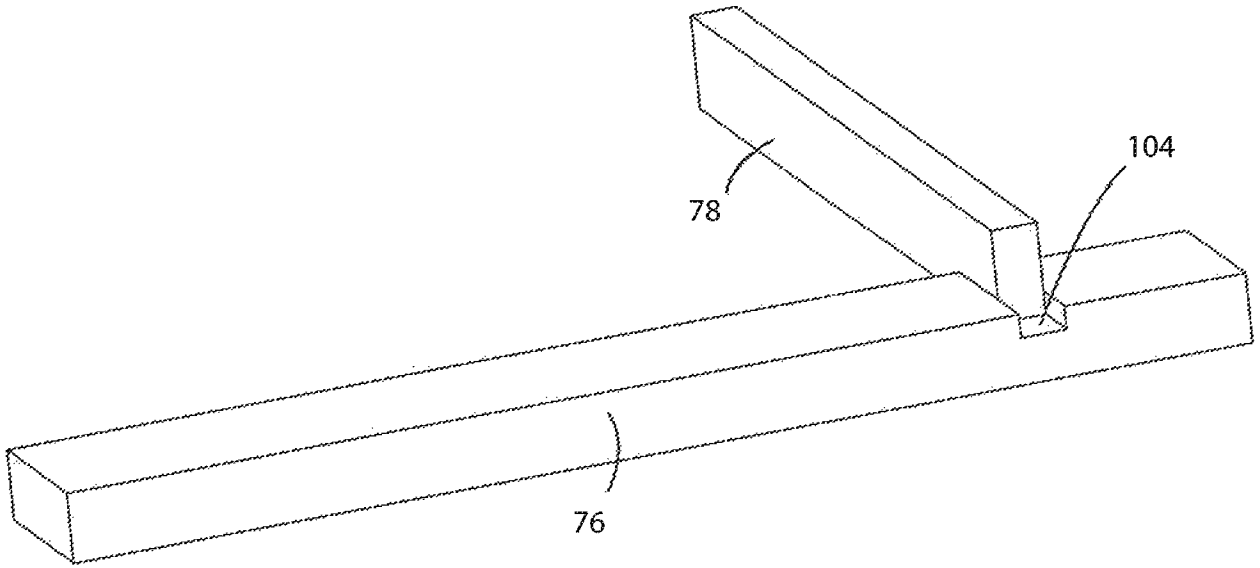
FIG. 21 is a perspective view of showing two workpieces to be connected via a dado.
Figure 22:
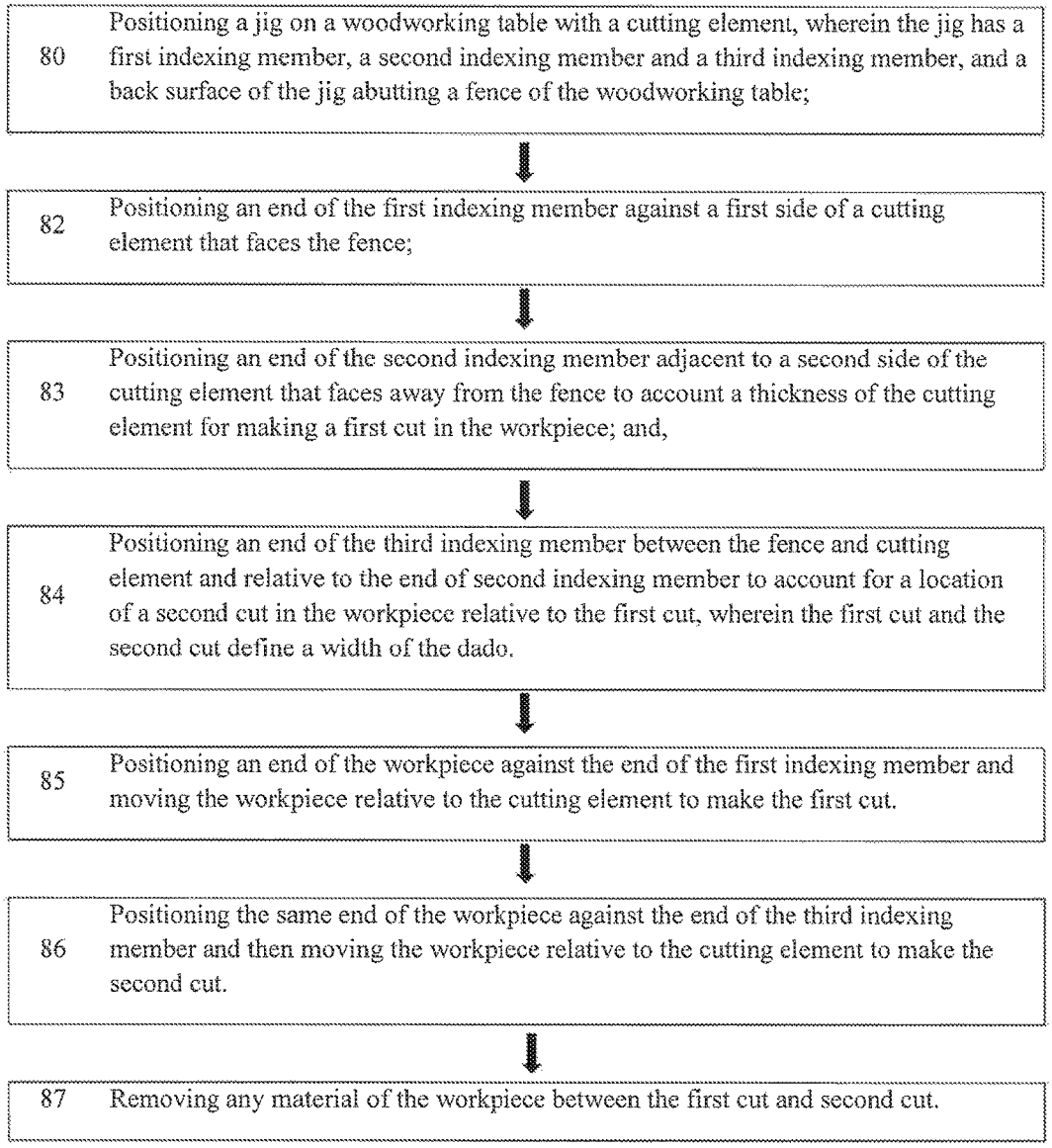
FIG. 22 is a flow chart describing different steps of a method of cutting a dado.

With respect to FIGS. 13-21 and the flow chart of FIG. 22, a method of cutting a dado is shown and described using the jig 10. As shown in FIG. 13, the jig 10 is positioned on the work table 62 including a fence 64 and cutting element 66, with the back surface 30 of the jig 10 abutting the fence 64 or a surface of the fence 64, A clamp 68 is used to secure the jig 10 against the fence 64. The cutting element 66 has a first side 66A facing the fence 64 and a second side 6613 facing away from the fence 64. In addition, the cutting element 66 includes cutting tips 72, along a peripheral edge of a body (not shown).

As shown in FIGS. 13 and 13A, and in step 82, the end 24 of the first indexing member 14 is positioned, or adjusted, in this embodiment by moving the fence 64 toward the cutting element 66, so the end 24 of the first indexing member is against, or abuts, a first side of the cutting element 66. In a preferred embodiment, the end surface 34 of the first indexing member should be positioned against one or side surfaces 72A of a cutting tip 72, which has a larger width or thickness dimension than the body of the cutting element 66.

Figures 14, 14A:
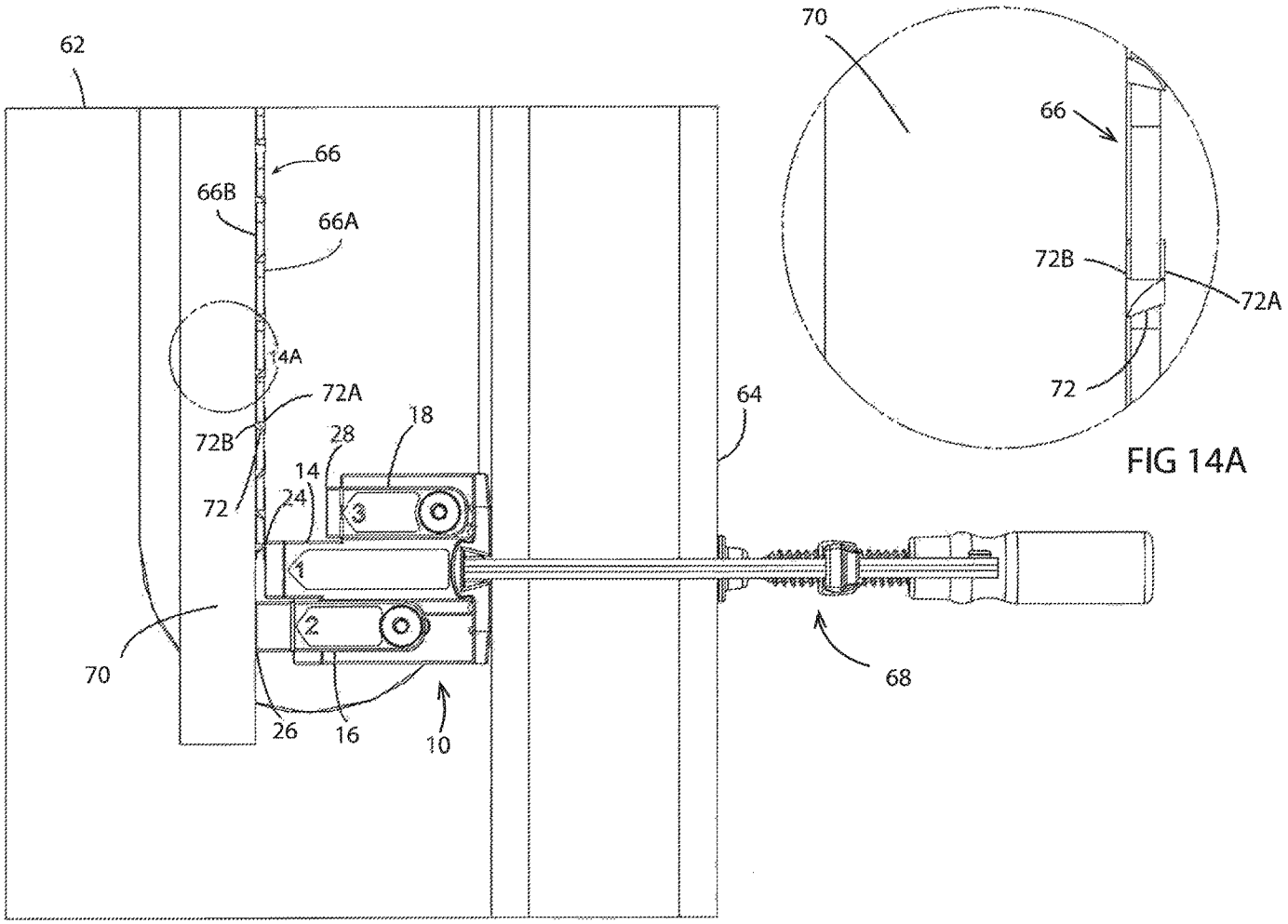
FIG. 14 is a top view of a table saw showing a second step of a method of cutting a dado.
FIG. 14A is a detailed top view of the cutting element and straight edge in FIG. 14.

In FIGS. 14 and 14A, and in step 83, the end 24 of the first indexing member 14 is abutting the first side 72A of the cutting element 66, and the end surface 36 of the second indexing member is positioned adjacent to a second side of the cutting element 66. As shown, a straight edge tool 70 abuts a second side of the cutting element 66, or abuts cutting tips 72 of the cutting element to replicate the second side 72B of the cutting element 66 or cutting tip 72. This relative positioning of the first indexing member 14 and second indexing member 16 in steps 80, 82 and 83 accounts for a thickness of the cutting element for making a first cut in a workpiece.

Figure 15:
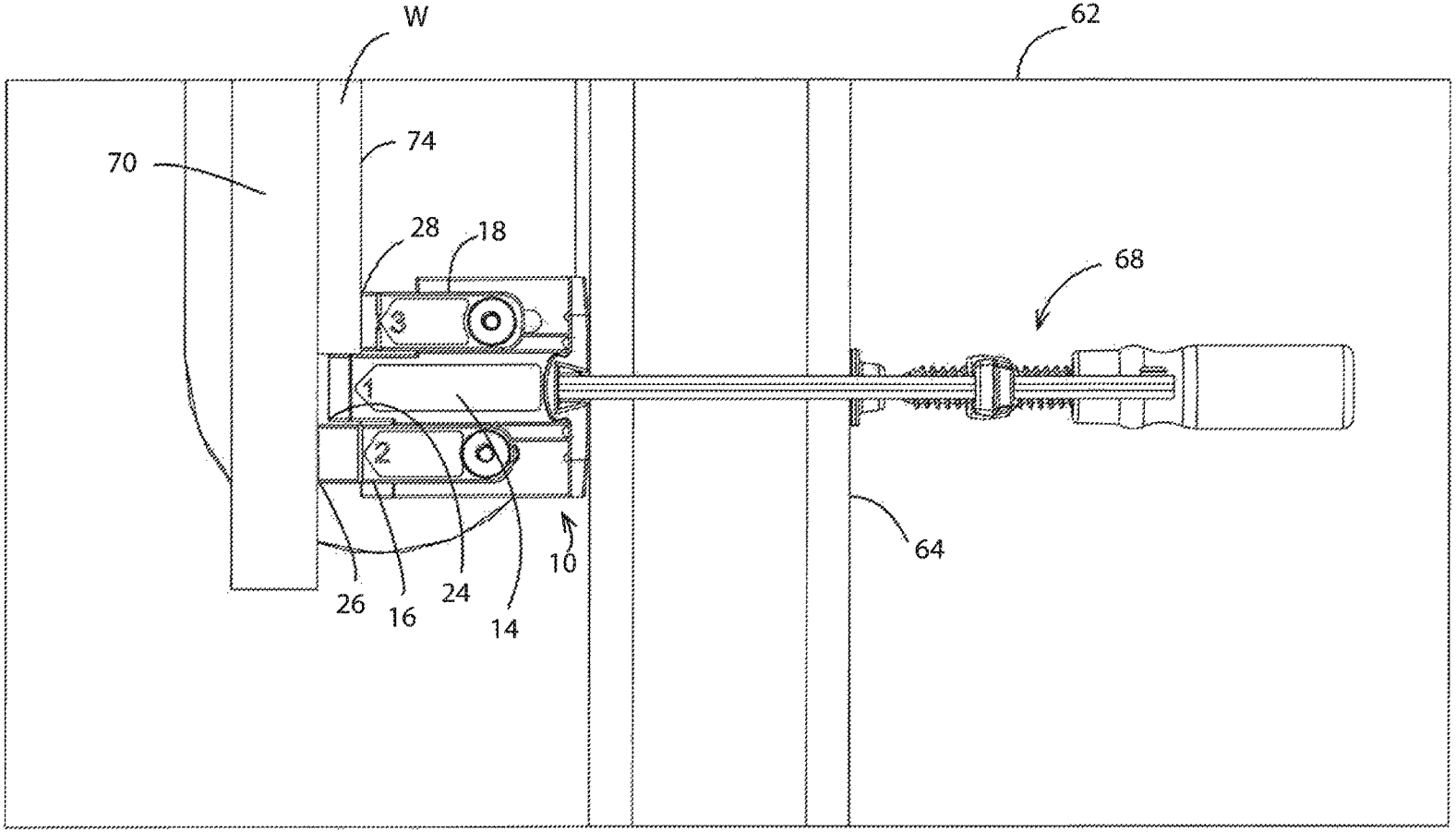
FIG. 15 is a top view of a table saw showing a third step of a method of cutting a dado.

In FIG. 15, and in step 84, the third indexing member 18, or the end surface 38 of the third indexing member 18, is positioned relative to the second indexing member 16, or the end surface 36 of the second indexing member to account for a width dimension of the dado to be cut. As shown, a workpiece 74 (or a second workpiece) is positioned between the end 28 of the third indexing member 18 and the straight edge tool 70, which has a surface (not shown) that is parallel to the end surfaces 34, 36, 38 of the indexing members 14, 16, 18 or the end 26 of the second indexing member 16. The workpiece 74 has a width dimension that corresponds to a width dimension W, which may also be referred to as a thickness dimension, of a dado to be cut into the second workpiece. Accordingly, in this step 84 the end 28 of the third indexing member 18 is positioned relative to end 26 of the second indexing member to account for a thickness of a dado, or the location of a second cut relative to the first cut. In order to perform this step 84, the cutting element 66 may be lowered to avoid having to move the jig 10 from the fence and table; however, the cutting element 66 may remain in position and the step 84 may be performed somewhere else on the work table or some other surface.

Figure 16:
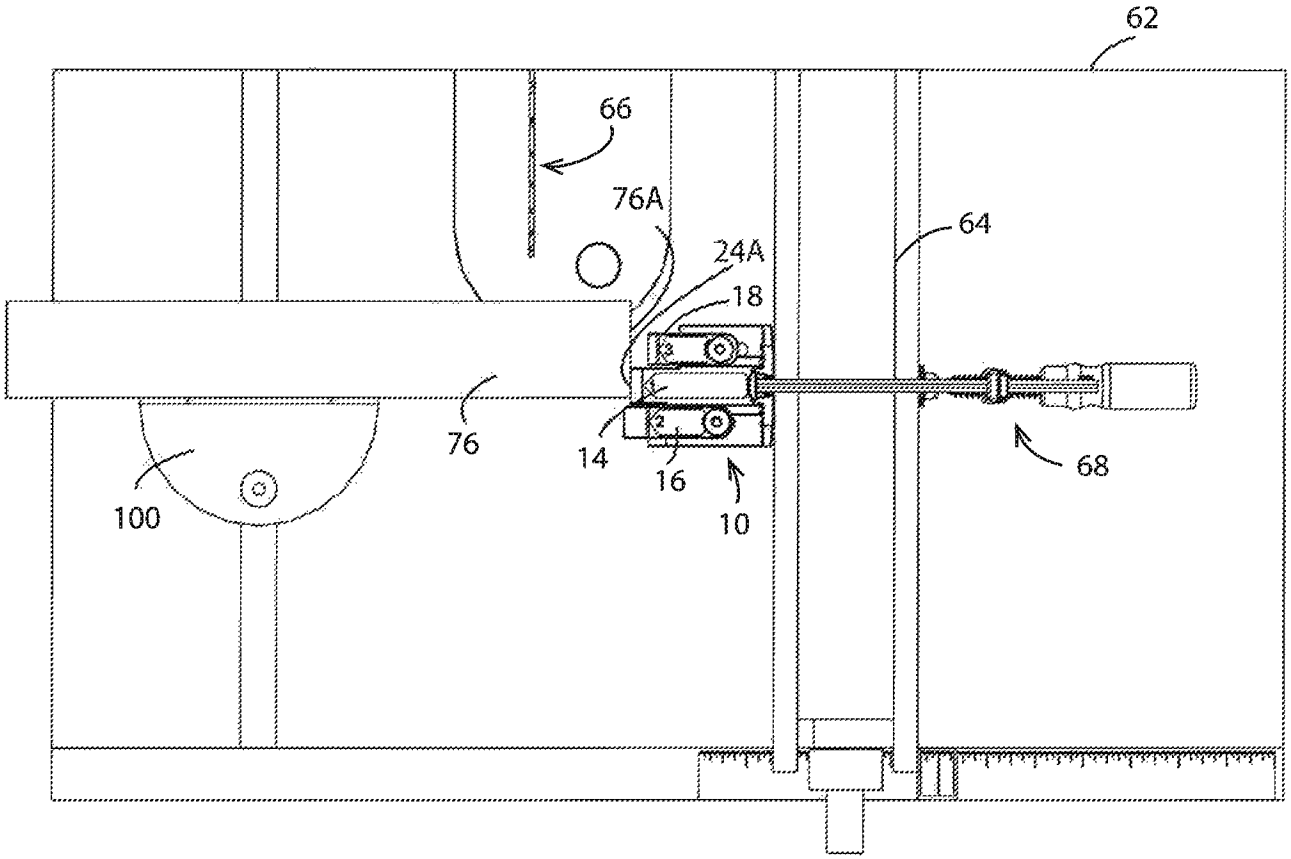
FIG. 16 is a top view of a table saw showing a fourth step of a method of cutting a dado.
Figure 17:
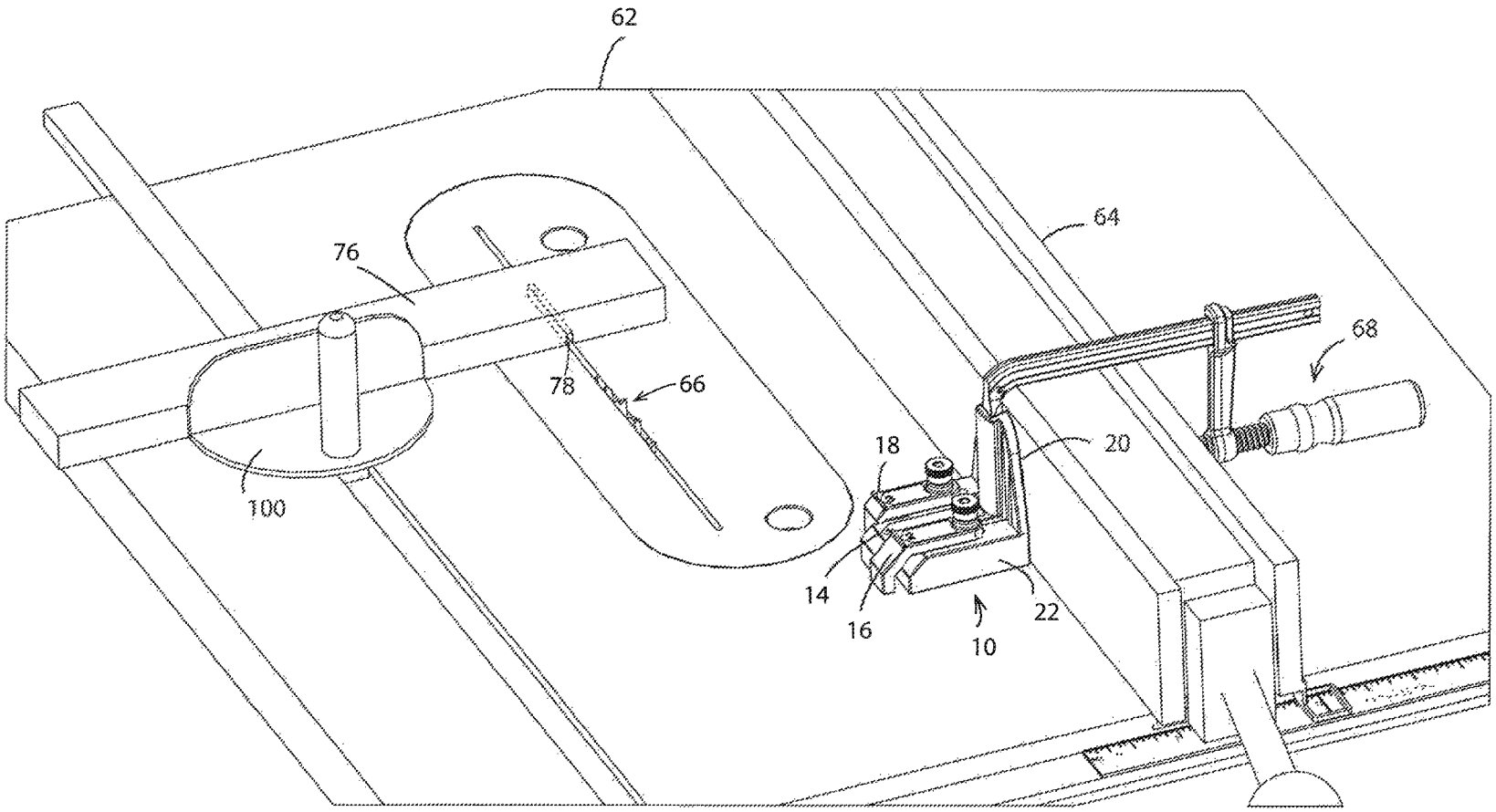
FIG. 17 is a perspective view of a table saw showing a fifth step of a method of cutting a dado.

In reference to FIGS. 16, 17, and in step 85, a first cut 78 is made into a first workpiece 76 by moving the workpiece 76 relative to the cutting element. As shown, an end 76A of the first workpiece 76 abuts the end 24 of the first indexing member 14 as the first workpiece 76 is advanced toward the cutting element 66. A miter gauge 100 may be used to stabilize the first workpiece 76 during cutting. In addition, as one skilled in the art will appreciate, the cutting element 66 relative to a top surface of the work table 62 should correspond to a desired depth of the dado to be cut.

Figure 18:
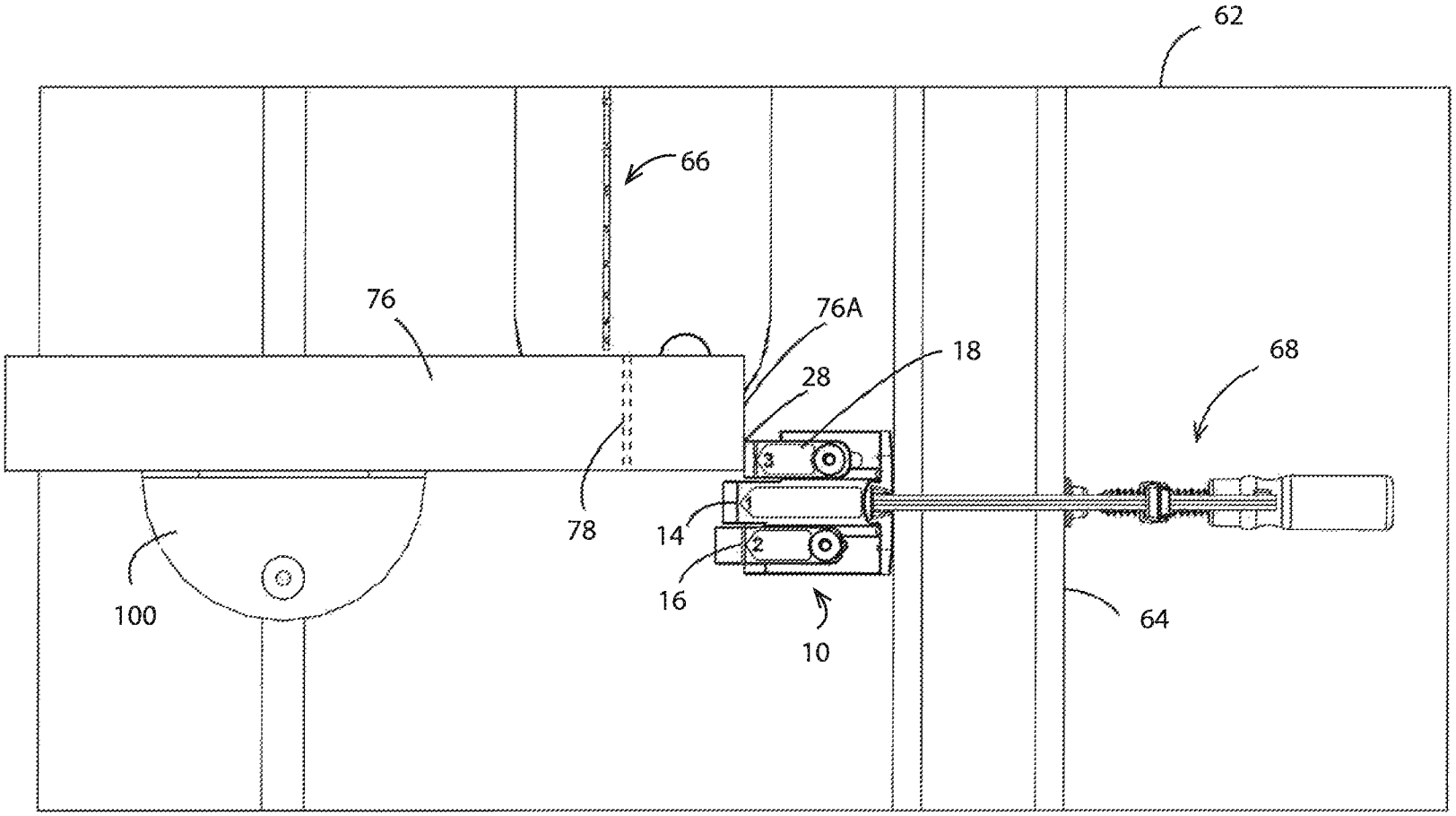
FIG. 18 is a top view of a table saw showing a sixth step of a method of cutting a dado.
Figure 19:
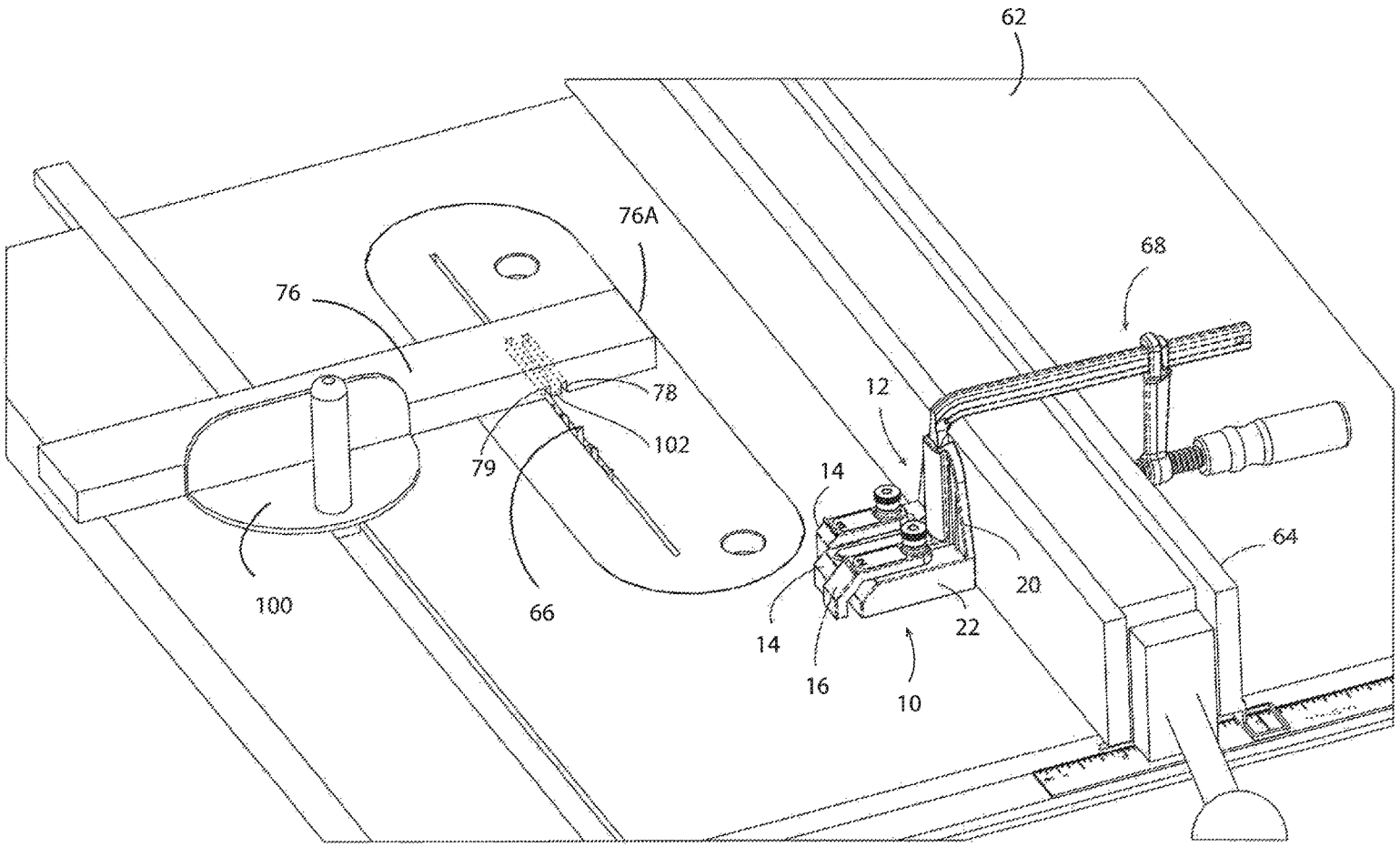
FIG. 19 is a perspective view of a table saw showing a seventh step of a method of cutting a dado.

The method then includes the set up for making a second cut in the first workpiece 76 wherein the first cut and second cut define a width dimension of a dado to be cut. As shown in FIGS. 18, 19 and in step 86, the end 76A of the first workpiece 76 is positioned against the end 28 of the third indexing member 18 to make a second cut 79. Accordingly, the first workpiece 76 is advanced toward and past the cutting element 66 to make the second cut 79. In this example, material 102 remains between the cuts 78, 79. In FIG. 20, and in step 88, the material 102 is removed by advancing the first workpiece 76 as many times as necessary to remove material 102 and form the dado 104.

Note, in order to prevent a workpiece from binding between fence and cutting element, before making the first cut 78 and second cut 79, the fence is positioned on the work table a sufficient distance from the cutting element 66 to make these cuts 78, 79. The first indexing member 14 has a set length, for example three inches. So for a dado width of ½ inch that will have the first cut 78 made four inches from the end of the workpiece and the second cut 79 will end at four and half inches from the end of the workpiece 76, the fence is positioned at seven inches, and the end 28, or end surface 38 of third index member 18 is positioned and locked ½ inch closer to the fence relative to the end 26, or end surface 36 of second indexing member 16. That is, the end 24, or end surface 34 of the first indexing member 14 is positioned four inches from the first side 72A of the cutting element 66 or a cutting tip. The fence 64 is locked at seven inches for both the first cut 78 and second cut 79. The length of the first indexing member 14 may vary and is not limited to three inches.

As shown in FIG. 21, the dado 104 is precisely cut to a desired width because the second workpiece 78 to be inserted may be used in positioning the end of the third indexing member 18 relative to the end 26 of the second indexing member 26 to define a width of the dado. While same workpiece 78 is shown in use to position the third indexing member 18, another workpiece (not shown), other than the actual workpiece that will be inserted in the dado, may be used as long as the width or thickness dimension is the same.

While embodiments of the invention have been described in reference to a table saw, one skilled in the art will appreciate the jig 10 may be used in the same manner with a table with a reverse mounted router.

While the preferred embodiments of the present invention have been shown and described herein, it will be obvious that such embodiments are provided by way of example only. Numerous variations, changes and substitutions will occur to those of skill in the art without departing from the invention herein. Non-limiting examples include a component that is described above as being attached to one part of the apparatus may alternatively be attached to a different part of the apparatus in other embodiments. Parts described as being indirectly connected may be connected directly to each other, and vice versa. Component parts may be assembled from individual pieces or may be integrally formed as a single unit. Alternative types of connectors and alternative materials may be used. The apparatus may be used with other types of power tools. Accordingly, it is intended that the invention be limited only by the spirit and scope of the appended claims.

The invention claimed is:

1. A dada indexing jig comprising:

a base having a back surface to abut a fence on a woodworking table;

a first indexing member connected to the base, and the first indexing member has a first side and a second side, the second side parallel to the first side, wherein the first and second sides are both perpendicular to the back surface of the base, and the first indexing member has an end with an end surface that is parallel to the back surface of the base;

a second indexing member connected to the base and adjacent to the first side of the first indexing member, and the second indexing member has an end with an end surface that is parallel to the back surface of the base, the second indexing member further having a first side and second side, the first side parallel to the second side;

wherein the end surface of the second indexing member is adjustable relative to the end surface of the first indexing member to define the width of a saw blade of the woodworking table, the end surface of the first indexing member and the second side of the second indexing member forming a right angle configured to receive a corner of a workpiece for making a first cut in the workpiece; and, a third indexing member connected to the base and adjacent to the second side of the first indexing member, and the third indexing member has an end with an end surface that is parallel to the back surface of the base, and the end surface of the third indexing member is adjustable relative to the end surface of the second indexing member defining a width dimension of a dado to be cut in the workpiece, the end surface of the third indexing member and the second side of the first indexing member forming a right angle configured to receive the corner of the workpiece.

2. The dado indexing jig of claim 1 wherein the first indexing member is fixed to the base and the base is detachably securable to the fence with the back surface of the base abutting the fence and the end of the first indexing member is adjusted by adjusting a position of the fence relative to the saw blade.

3. The dado indexing jig of claim 2 further comprising a clamp connected to the base to affix the base to the fence of the woodworking table.

4. The dado indexing jig of claim 2 wherein the second indexing member and third indexing member are in sliding engagement with the base.

5. The dado indexing jig of claim 4 further comprising a first releasable stop mechanism operatively connected to the second indexing member and the base and a second releasable stop mechanism operatively connected to the third indexing member and the base.

6. The dado indexing jig of claim 5 wherein the base has a first slot and a second slot, wherein the second indexing member has a first protrusion disposed in mating relationship with the first slot, and the third indexing member has a second protrusion disposed in mating relationship with the second slot.

7. The dado indexing jig of claim 4 wherein the base comprises a vertical section connected to a horizontal section, and the back surface of the base is on the vertical section, and the second indexing member and the third indexing member are disposed in sliding engagement on the horizontal section.

8. The dado indexing jig of claim 7 wherein the base has a vertically disposed channel along the back surface and the jig further comprises a clamp with a clamp arm insertable within the channel.

9. The dado indexing jig of claim 1 wherein the base has a first bottom surface, and the second indexing member has a second bottom surface, and the third indexing member has a third bottom surface, wherein the second bottom surface and the third bottom surface are vertically offset relative to the first bottom surface.

10. A dada indexing jig comprising:

a base having a back surface to abut a movable fence on a woodworking table, the fence being adjustable with respect to a saw blade;

a first indexing member integrally formed with the base and is not adjustable, the first indexing member has a first side and a second side, the second side parallel to the first side, wherein the first and second sides are both perpendicular to the back surface of the base, the first indexing member further having an end with an end surface that is parallel to the back surface of the base, the end, first side, and second side of the first indexing member and the base defining a periphery;

a second indexing member connected in sliding engagement to the base and adjacent to the first side of the first indexing member, and the second indexing member has an end outside the periphery, the end of the second indexing member further having an end surface that is parallel to the back surface of the base;

wherein the end of the second indexing member is adjustable to a position where the distance from the end surface of the second indexing member to the back surface is greater than the distance from the end surface of first indexing member to the back surface to define a width of the saw blade, and wherein the end of the first indexing member and the end of the second indexing member are each adjustable to respective positions adjacent to a saw blade of the woodworking table for making a first cut in a workpiece by positioning the movable fence relative to the saw blade; and, a third indexing member connected in sliding engagement to the base and adjacent to the second side of the first indexing member, the third indexing member has an end outside the periphery with an end surface that is parallel to the back surface of the base, and the end of the third indexing member is adjustable to a position where the distance from the end surface of the first indexing member to the back surface is greater than the distance from the end surface of third indexing member to the back surface for making a second cut in the workpiece, wherein the first cut and second cut define a width of a dado to be cut in the workpiece.

11. A dado indexing jig comprising:

a base comprising a vertical section connected to a horizontal section, the vertical section having a back surface to abut a fence on a woodworking table, the vertical section further having a channel along the back surface to receive a clamp with a clamp arm insertable within the channel to detachably secure the base to be to the fence;

a first indexing member fixed to the base, and the first indexing member has a first side that is parallel to a second side thereof, wherein the first and second sides are both perpendicular to the back surface of the base, and the first indexing member has an end with an end surface that is parallel to the back surface of the base, the first indexing member is adjusted by adjusting a position of the fence relative to a saw blade;

a second indexing member connected in sliding engagement to the horizontal section of the base and adjacent to the first side of the first indexing member, and the second indexing member has an end with an end surface that is parallel to the back surface of the base;

wherein the end of the first indexing member and the end of the second indexing member are each adjustable relative to one another to define a width of a saw blade of the woodworking table for making a first cut in a workpiece; and, a third indexing member connected in sliding engagement to the horizontal section of the base and adjacent to the second side of the first indexing member, the third indexing member having an end with an end surface that is parallel to the back surface of the base, and the end of the third indexing member is adjustable to a position relative to the end of the second indexing member defining a width of a dado to be cut in the workpiece.

* * * * *